US011662181B1

(12) United States Patent
Johnston

(10) Patent No.: US 11,662,181 B1
(45) Date of Patent: May 30, 2023

(54) SURVIVABILITY AND ASSAULT MULTI-TOOL SYSTEMS AND METHODS

(71) Applicant: United States of America as Represented by The Secretary of The Army, Alexandria, VA (US)

(72) Inventor: Gary E Johnston, Vicksburg, MS (US)

(73) Assignee: UNITED STATES OF AMERICA AS REPRESENTED BY THE SECRETARY OF THE ARMY, Alexandria, VA (US)

( * ) Notice: Subject to any disclaimer, the term of this patent is extended or adjusted under 35 U.S.C. 154(b) by 0 days.

(21) Appl. No.: 17/395,375

(22) Filed: Aug. 5, 2021

(51) Int. Cl.
*F41H 5/08* (2006.01)
*E06C 1/10* (2006.01)
*E01D 15/12* (2006.01)

(52) U.S. Cl.
CPC ..... *F41H 5/08* (2013.01); *E01D 15/124* (2013.01); *E06C 1/10* (2013.01)

(58) Field of Classification Search
CPC ... F41H 5/08; F41H 1/00; F41H 11/00; F41H 13/00; E01D 15/124; E06C 1/10; E06C 1/12
See application file for complete search history.

(56) References Cited

U.S. PATENT DOCUMENTS 6,807,890 B1 * 10/2004 Fuqua ..... F41H 5/08 89/36.02
2002/0092416 A1 * 7/2002 Cohen ..... F41H 5/06 89/36.05
2019/0048663 A1 * 2/2019 Kay ..... E06C 7/486
2019/0323294 A1 * 10/2019 Villegas Cantu ..... E06C 1/12

* cited by examiner

*Primary Examiner* — J. Woodrow Eldred
(74) *Attorney, Agent, or Firm* — Brian C. Jones

(57) ABSTRACT

Survivability and assault multi-tool assemblies and systems that can be used in combat and tactical situations. Exemplary survivability and assault multi-tool assemblies can include a first side support, a second side support, a middle rung coupled with the first side support and the second side support, a panel coupled with the first side support and the second side support, a folding rung pivotably coupled with the first side support and the second side support, and a sliding rung slidingly received by the first side support and the second side support. Multiple survivability and assault multi-tool assemblies can be coupled together to form a survivability and assault multi-tool system.

20 Claims, 18 Drawing Sheets

SURVIVABILITY AND ASSAULT MULTI-TOOL SYSTEMS AND METHODS

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees.

BACKGROUND

Field of the Invention

The present invention relates to combat devices, and more particularly but not exclusively, to fighting position overhead cover or survivability/assault multi-tool (SAM) assemblies and methods for their use and manufacture.

Description of the Related Art

This section introduces aspects that may help facilitate a better understanding of the invention. Accordingly, the statements of this section are to be read in this light and are not to be understood as admissions about what is prior art or what is not prior art.

To protect and enable personnel in conflict and tactical situations, organizations such as the military use a variety of protective and utility devices, including shields, ladders, and the like.

Although currently available protection and utility systems provide valuable protection in many instances, still further improvements are desirable. Embodiments of the present invention provide solutions to at least some of these outstanding needs.

SUMMARY

The present invention was developed to address the challenges described in the Background section. Additional research and further development has led to a novel approach to provide improved survivability/assault multi-tool (SAM) assemblies and methods for use in combat and tactical situations.

In some embodiments, a multi-tool system includes four multi-tool assemblies, where each assembly includes a reinforced ballistic panel. A system can include a set of four survivability reinforced ballistic panels that can function independently or linked with other panels to provide a range of protection or mobility functions for dismounted forces in both defensive and offensive operations. Each panel can provide protection from a 7.62×51 round and can be attached with a carrying strap to aid in deployment. In some embodiments, a set of set of four assemblies can stack in a space approximately 3' long×2' wide×1' high to allow for storage on or in combat vehicles. The system can be designed to address various mission sets associated with both defensive and urban operations, including (a) overhead cover, (b) assault shield, (c) assault ladder, and (d) foot bridge.

BRIEF DESCRIPTION OF THE DRAWINGS

Embodiments of the invention will become more fully apparent from the following detailed description, the appended claims, and the accompanying drawings in which like reference numerals identify similar or identical elements.

DETAILED DESCRIPTION

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

As used herein, the singular forms "a," "an," and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Figure 1A:
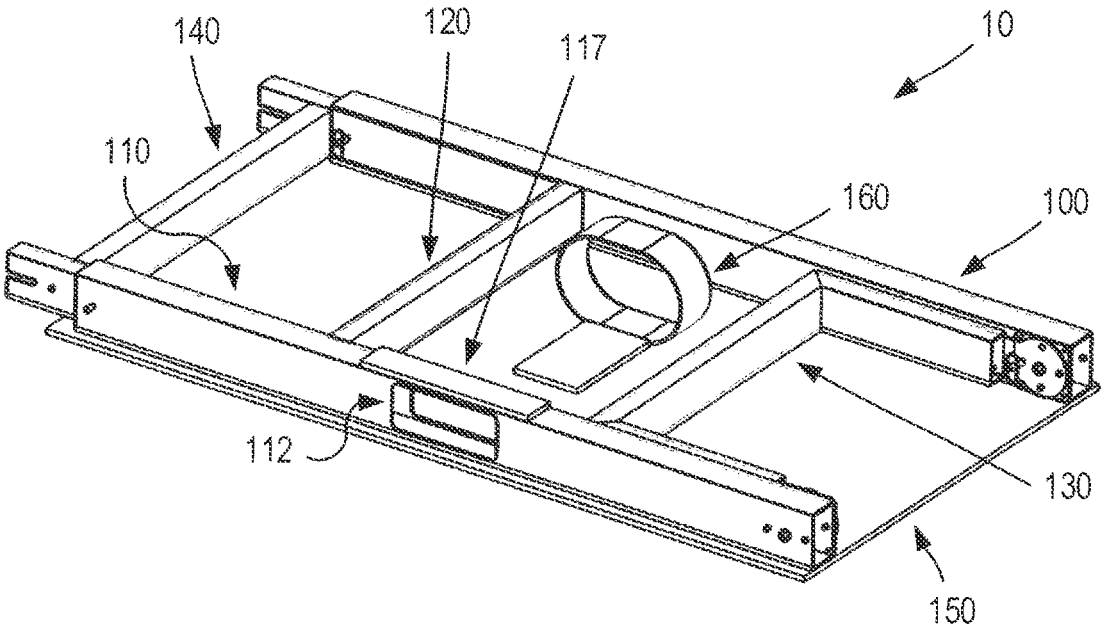
FIGS. 1A and 1B depict aspects of an exemplary survivability/assault multi-tool (SAM) assembly, according to certain embodiments of the invention.
Figure 1B:
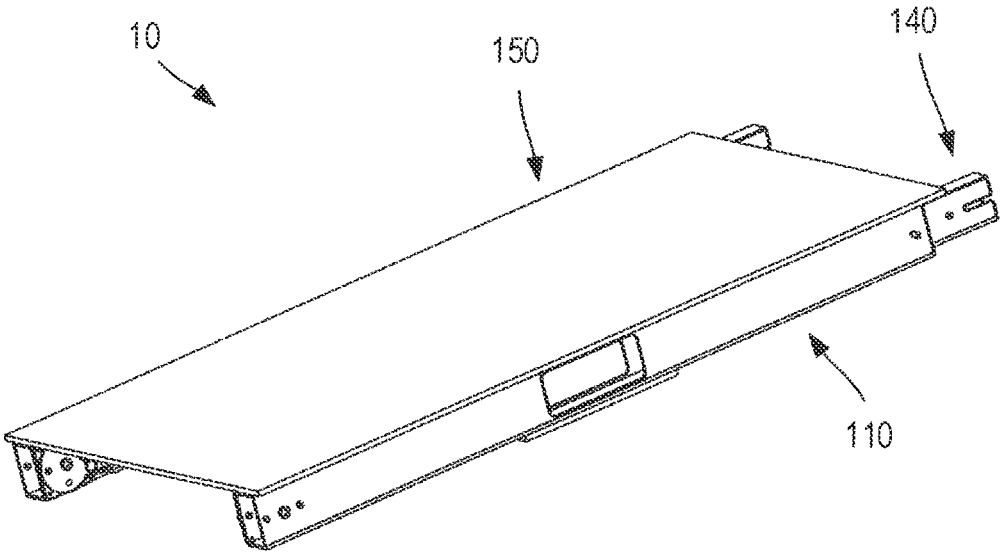

Turning now to the drawings, FIGS. 1A and 1B depict aspects of a multi-tool assembly 10, according to embodiments of the present invention. As shown here, assembly 10 includes a first side support 100, a second side support 110, and a middle rung or fixed rung 120 disposed between and in fixed connection with the first and second side supports. Assembly 10 further includes a swing arm or folding rung 130 in pivoting association with the first and second side supports, a sliding arm or sliding rung 140 in sliding association with the first and second side supports, a panel 150 coupled with the first and second side supports, and an arm strap 160 coupled with the panel. Second side support 110 includes an aperture 112. In use, a person can slide their right or left arm through the arm strap 160 and, with the hand of that arm, grasp a handle portion that is provided by an aperture 112 in the second side support 110. Second side support 110 may also include or be coupled with a support plate 117, which can provide reinforcement or additional load-bearing capabilities to the second side support 110.

Overhead Cover

One or more assemblies can be used for individual fighting positions. In some embodiments, a panel extends to approximately 5' to form a cover for a standard individual fighting position. The extension allows for bearing on the soil banks required to support the assembly across the fighting position for both soil cover and blast loads from indirect fires primarily mortars. The extension can be achieved by having the ladder rung support arm or sliding rung 140 slide out from one end of the assembly and rotating the swing arm or folding rung 130 at the other end with fixed positioning at either 90° or 180° relative to the side supports. An individual panel 150 can provide immediate ballistic protection from air burst fragmentation equivalent to the 7.62×51. The panel(s) can be covered with soil or sandbags to increase protection from both fragmentation and contact burst from medium mortars. Assemblies can be paired together to provide the desired cover for a two soldier fighting situation. In some cases, a panel 150 can provide a coverage area of 36" by 20".

Figure 2A:
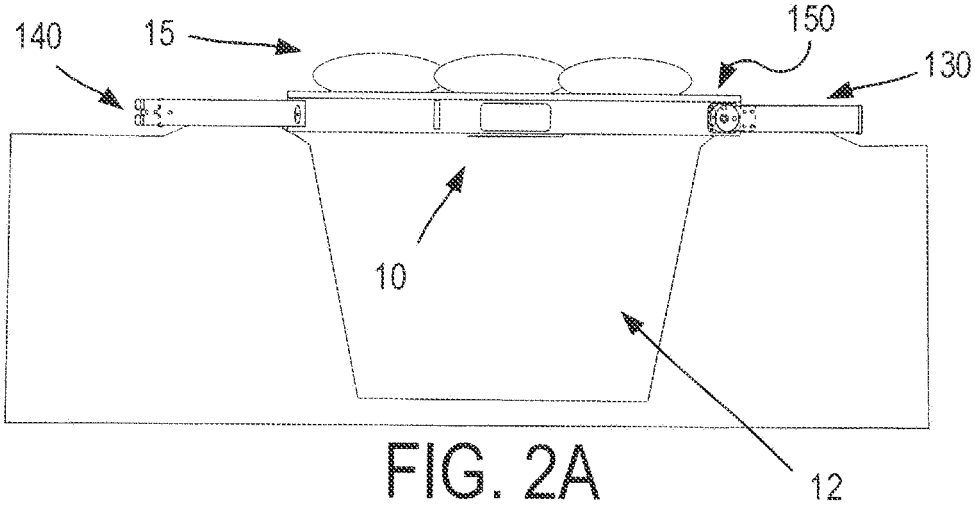
FIGS. 2A, 2B depict, and 2C depict aspects of exemplary survivability/assault multi-tool (SAM) assemblies, according to certain embodiments of the invention.
Figure 2B:
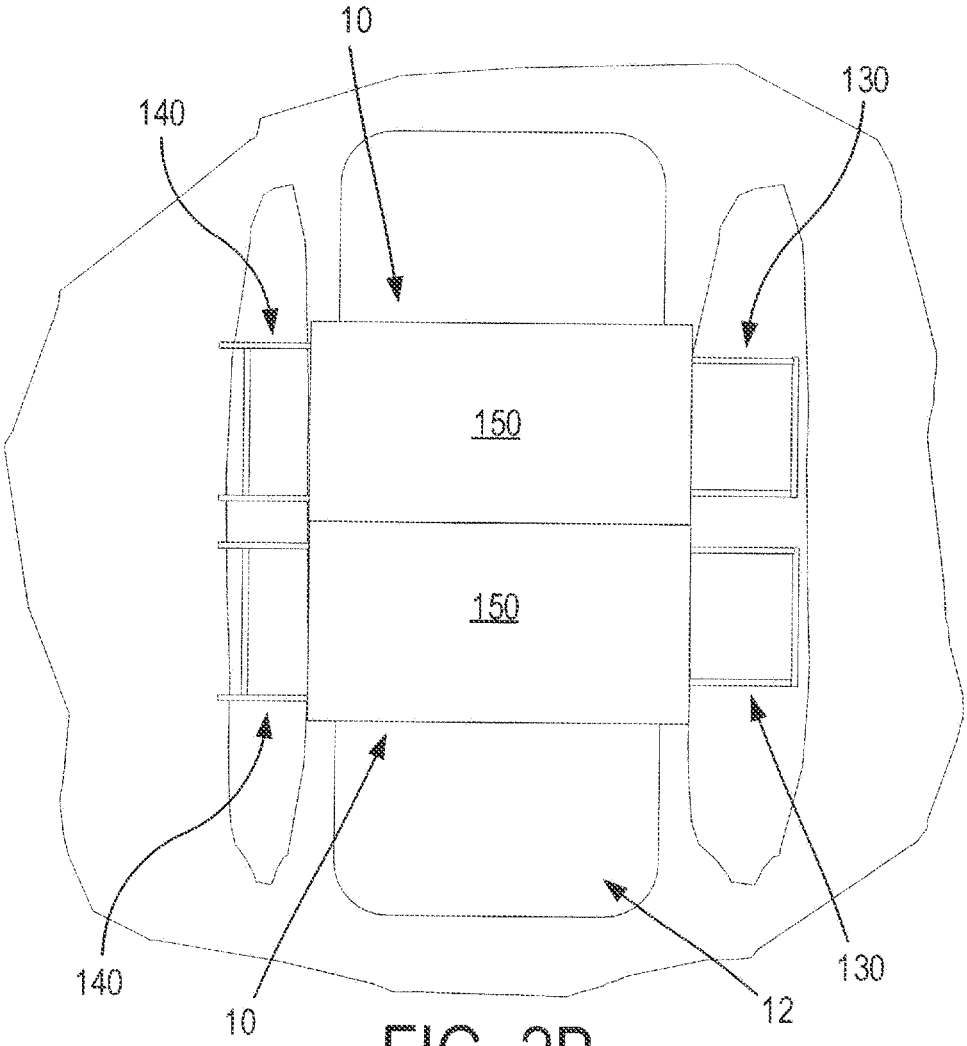

As shown in the side view provided by FIG. 2A and the top plan view provided by FIG. 2B, one or more assemblies 10 can be placed across a foxhole or trench 12. In this configuration, the sliding rung 140 is extended, and the folding rung 130 is unfolded. Sandbags 15 can be placed on top of the panel 150. As shown in the top plan view provided by FIG. 2B, two assemblies 10 can be placed side by side over a foxhole or trench 12. This configuration can provide a fixed rail structure, and can hold additional sandbags on top. Such sandbags are helpful for protecting individuals under the assemblies from contact bursts, mortar rounds, and the like, operating to absorb blast impacts, and improving survivability. In some cases, the panels may provide protection from ballistic impacts, and may include a Kevlar material for ballistic protection. Assembly components can be manufactured from aluminum, or other strong and light materials. As shown in the side view provided by FIG. 2C, the folding rung 130 can be folded to a 90° orientation relative to the side supports, and one or more assemblies 10 in this configuration can be placed over a foxhole or trench to allow an individual to view or fire forward from under the assembly or assemblies. As shown here, the sliding rung 140 is placed upon a spoil 141.

Figure 2C:
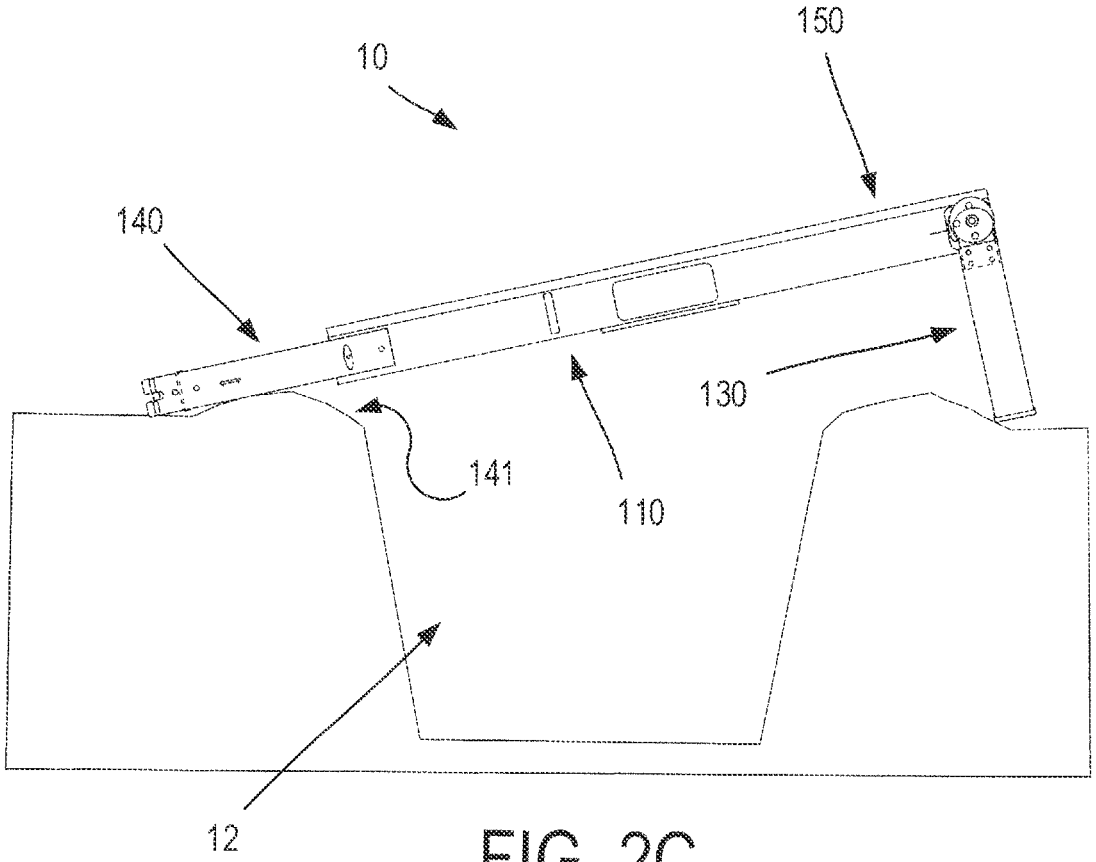

FIG. 2A depicts a standard fighting position, where the folding run 130 is folded to 180° and the sliding rung 140 is slide out. In some cases, this results in a 57"×20" cover section. Two or more assemblies can be used to form a cover as shown in FIG. 2B. FIG. 2C depicts a single firer application, where the folding rung 130 is folded to 90°, and the sliding rung 140 is extended, allowing for firing from under the cover. Here, the two rungs 130, 140 bear on or are in contact with the soil. The panel dimensions can be sized so as to provide sufficient cover over both sides of a foxhole or fighting position. One or more panels can operate as a shielding portion, providing immediate protection and/or overhead cover using light ballistic materials.

Method embodiments for operating a survivability and assault multi-tool assembly can include slidably moving a sliding rung of the multi-tool assembly relative to a first side support and a second side support of the multi-tool assembly, fixing the sliding rung of the multi-tool assembly relative to the first side support and the second side support of the multi-tool assembly, pivotably moving a folding rung of the multi-tool assembly relative to the first side support and the second side support of the multi-tool assembly, and fixing the folding rung of the multi-tool assembly relative to the first side support and the second side support of the multi-tool assembly. In some cases, the step of fixing the sliding rung of the multi-tool assembly relative to the first side support and the second side support of the multi-tool assembly includes inserting a first pin through an aperture of a first lateral support of the sliding rung and through an aperture of the first side support, and inserting a second pin through an aperture of a second lateral support of the sliding rung and through an aperture of the second side support. In some cases, the step of fixing the folding rung of the multi-tool assembly relative to the first side support and the second side support of the multi-tool assembly includes inserting a first pin through an aperture of a first hinge post of the folding rung and through an aperture of the first side support, and inserting a second pin through an aperture of a second hinge post of the folding rung and through an aperture of the second side support. In some cases, the step of fixing the folding rung of the multi-tool assembly relative to the first side support and the second side support of the multi-tool assembly includes fixing a first lateral support of the folding rung at a 90° angle relative to the first side support, and fixing a second lateral support of the folding rung at a 90° angle relative to the second side support. In some cases, the step of fixing the folding rung of the multi-tool assembly relative to the first side support and the second side support of the multi-tool assembly includes fixing a first lateral support of the folding rung at a 180° angle relative to the first side support, and fixing a second lateral support of the folding rung at a 180° angle relative to the second side support. In some cases, the step of fixing the folding rung of the multi-tool assembly relative to the first side support and the second side support of the multi-tool assembly includes fixing a first lateral support of the folding rung at a 0° angle relative to the first side support, and fixing a second lateral support of the folding rung at a 0° angle relative to the second side support.

Assault Shield

Figure 3A:
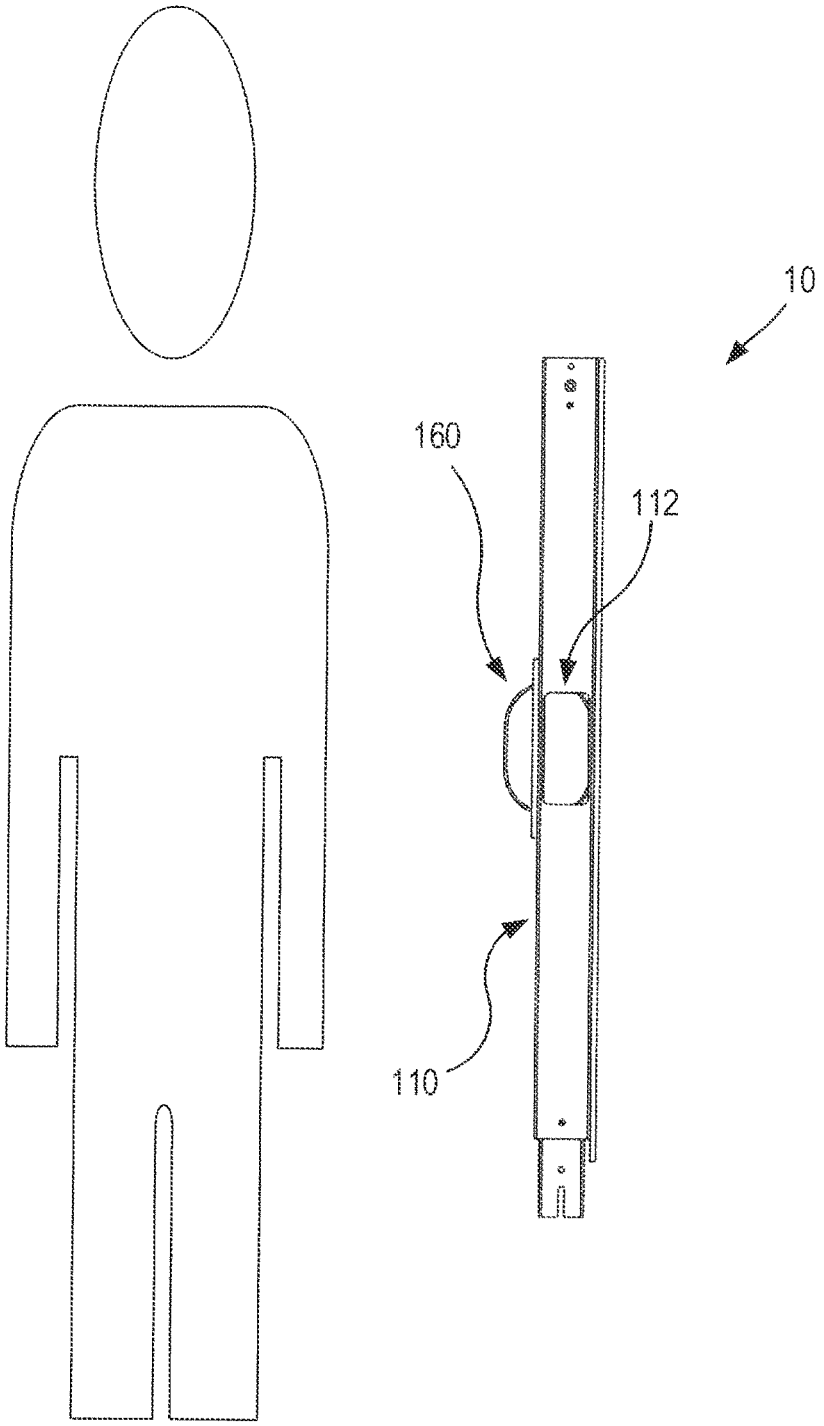
FIGS. 3A and 3B depict aspects of exemplary survivability/assault multi-tool (SAM) assemblies, according to certain embodiments of the invention.
Figure 3B:
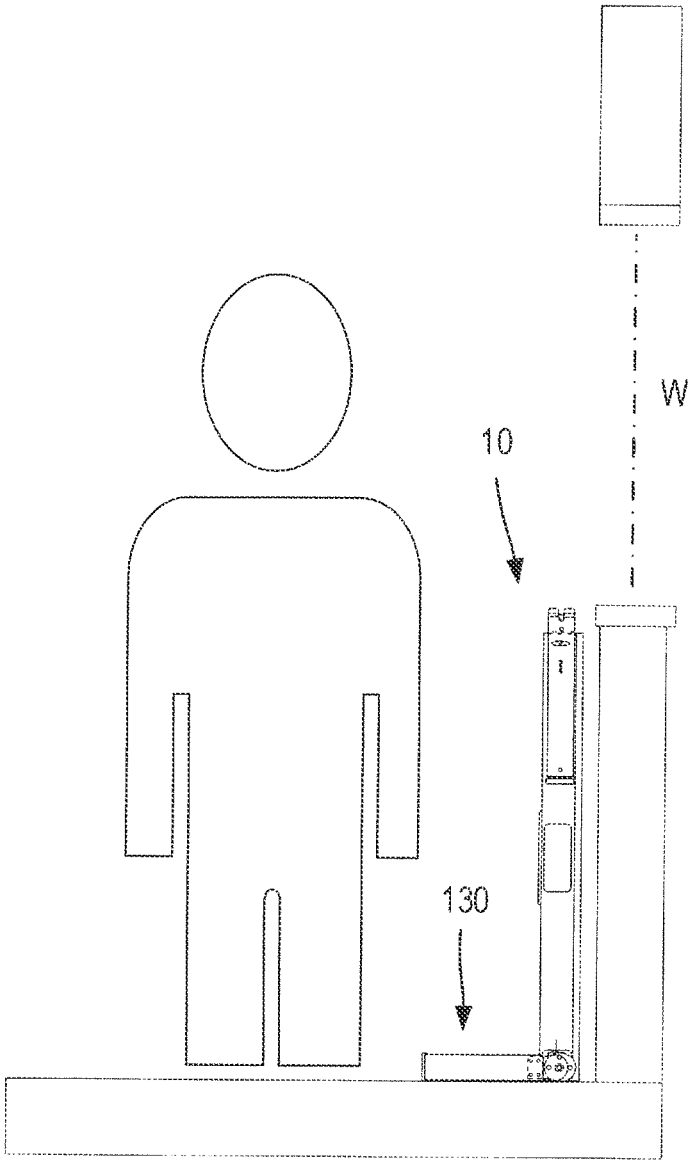

In some cases, an assembly 10 can be used as an assault shield, as depicted in FIG. 3A. For example, a person can slide their arm through the arm strap 160 and, with the hand of that arm, grasp a handle portion that is provided by an aperture 112 in the second side support 110, and hold the assembly 10 in front of their body. In some cases, such use may be desired for an urban operation. In this sense, an assembly 10 can function independently as an assault shield. One support rail or side support is fitted with a handhold and an arm strap is attached to the ballistic panel for stability and centered on the panel. This allows the assembly 10 to operate as a shield to be used for both right and left hand operations simply by rotating the assembly 180°. Rotating the support arm or folding arm 130 at 90° allows the assembly to be self-supporting to support both prone and kneeling positions and the reinforcement of walls in an urban environment, as depicted in FIG. 3B, where the assembly 10 is placed on the floor beneath a window W. In this way, an assembly 10 can provide an urban wall ballistic reinforcement.

Assault Ladder

Figure 4:
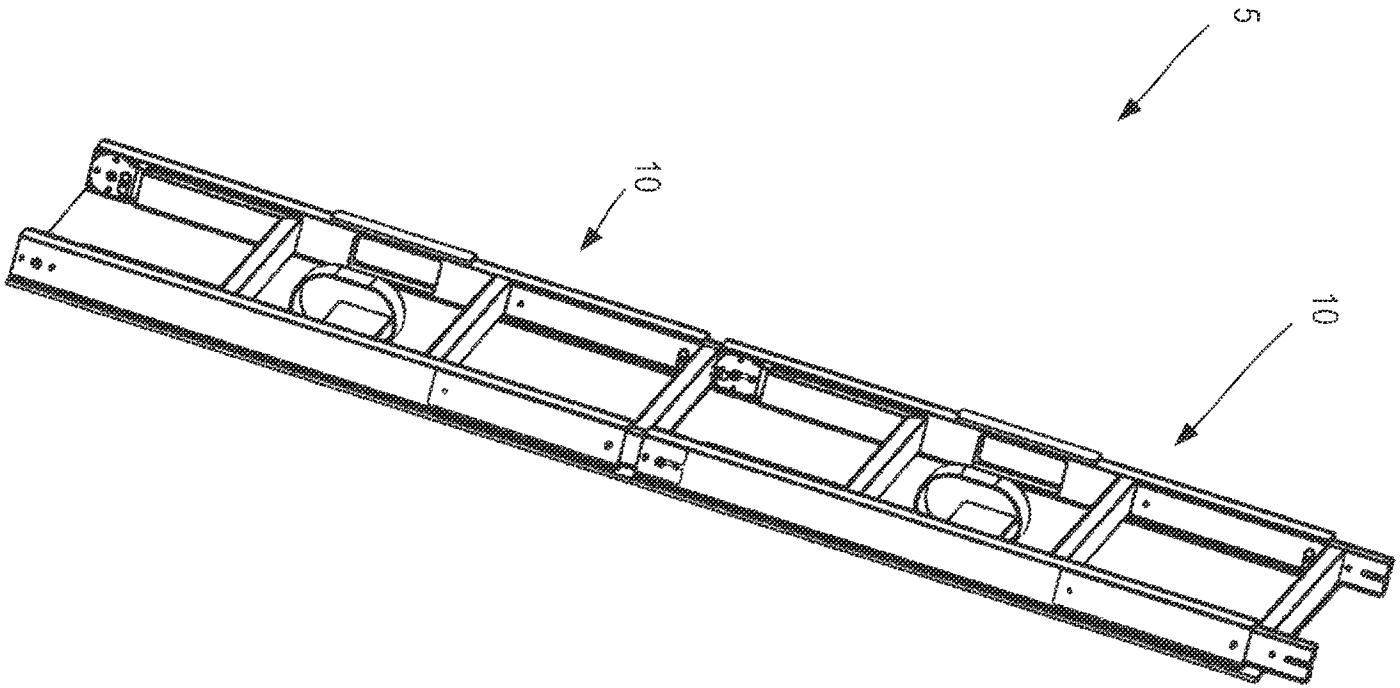
FIG. 4 depicts aspects of an exemplary survivability/assault multi-tool (SAM) system, according to certain embodiments of the invention.

In some cases, an assembly 10 can be used as an assault ladder, and relatedly, multiple assemblies 10 can be coupled together to operate as an assault ladder 5, as depicted in FIG. 4. In some cases, multiple assemblies can be pinned together to provide an assault ladder. Each assembly can provide a 3 rung 3' ladder to support breaching low walls and a carrying strap can enable retrieval of the ladder. The individual assemblies can be pinned together form taller ladders. A set of four assemblies can provide for ladder lengths ranging from 3', 6', 9' and 12'. A 12' ladder can be capable of carrying a load of 300 pounds. Additional assemblies can be added to provide taller ladders at reduced load capacity. The ballistic panel offers protection from frontal fires while scaling the ladder. Portions of the ladder steps or rungs which operate as the stepping surfaces can include a textured material or surface for improved performance. For example, the top surfaces of the rungs can include plank grating or skid resistant treads, or may have a diamond deck textured surface. According to some embodiments, a survivability and assault multi-tool system can be provided as a ladder 5, and can include a first multi-tool assembly 10 having a first side support, a second side support, a panel, and a sliding rung having a first lateral support and a second lateral support. The ladder can also include a second multi-tool assembly 10 having a first side support, a second side support, a panel, and a folding rung having a first lateral support and a second lateral support. The first lateral support of the sliding rung can be slidably received by the first side support of the first multi-tool assembly and the second lateral support of the sliding rung is slidably received by the second side support of the first multi-tool assembly. The first lateral support of the sliding rung can be slidably received by the first side support of the second multi-tool assembly and the second lateral support of sliding rung can be slidably received by the second side support of the second multi-tool assembly. The first lateral support of the folding rung can be pivotably coupled with the first side support of the second multi-tool assembly and the second lateral support of the folding rung can be pivotably coupled with the second side support of the second multi-tool assembly. A first pin of the first multi-tool assembly can be configured to fix the first lateral support of the sliding rung relative to the first side support of the first multi-tool assembly, and a second pin of the first multi-tool assembly can be configured to fix the second lateral support of the sliding rung relative to the second side support of the first multi-tool assembly. A first pin of the second multi-tool assembly can be configured to fix the first lateral support of the folding rung relative to the first side support of the second multi-tool assembly, and a second pin of the second multi-tool assembly can be configured to fix the second lateral support of the folding rung relative to the second side support of the second multi-tool assembly. In some cases, a panel of the first multi-tool assembly abuts the panel of the second multi-tool assembly when the first multi-tool assembly and the second multi-tool assembly are coupled together.

Foot Bridge

Figure 5A:
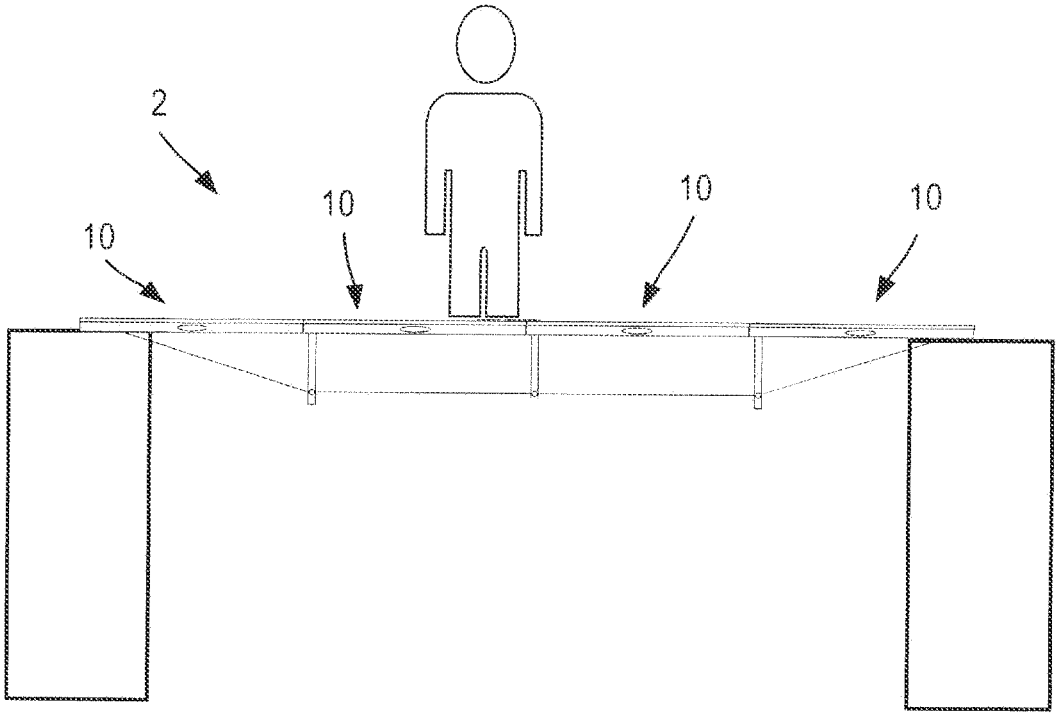
FIGS. 5A and 5B depict aspects of exemplary survivability/assault multi-tool (SAM) systems, according to certain embodiments of the invention.
Figure 5B:
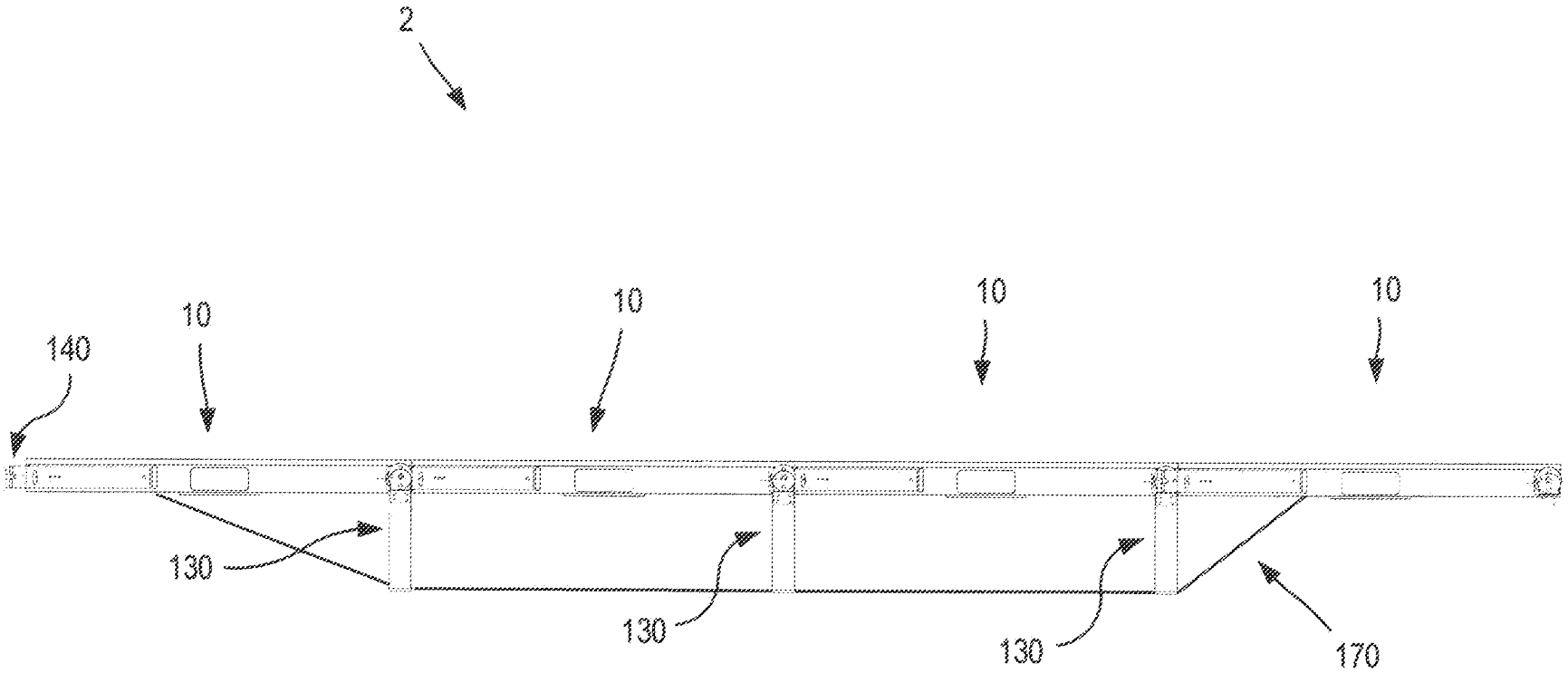

In some cases, an assembly 10 can be used as a foot bridge, and relatedly, multiple assemblies 10 can be coupled together to operate as a foot bridge 2, as depicted in FIGS. 5A and 5B. The ladder 2 can be extended across a gap with the ballistic panels facing upward, to operate as a crossing deck. A 12' foot bridge can support the crossing of a soldier with body army (approximately 300 pounds). For a higher loading or longer gaps, the bridge function can be reinforced by creating "king post" supports by rotating the swing arm or folding rung 130 to the 90° position and attaching the carrying straps 170 to the folding arm 130 and fixed ladder rungs to provide a post tensioned support to the bridge. According to some embodiments, a survivability and assault multi-tool system can be provided as a foot bridge 2, and can include a first multi-tool assembly 10 having a first side support, a second side support, a panel, and a sliding rung having a first lateral support and a second lateral support. The foot bridge can also include a second multi-tool assembly 10 having a first side support, a second side support, a panel, and a folding rung having a first lateral support and a second lateral support. The first lateral support of the sliding rung can be slidably received by the first side support of the first multi-tool assembly and the second lateral support of the sliding rung is slidably received by the second side support of the first multi-tool assembly. The first lateral support of the sliding rung can be slidably received by the first side support of the second multi-tool assembly and the second lateral support of sliding rung can be slidably received by the second side support of the second multi-tool assembly. The first lateral support of the folding rung can be pivotably coupled with the first side support of the second multi-tool assembly and the second lateral support of the folding rung can be pivotably coupled with the second side support of the second multi-tool assembly. A first pin of the first multi-tool assembly can be configured to fix the first lateral support of the sliding rung relative to the first side support of the first multi-tool assembly, and a second pin of the first multi-tool assembly can be configured to fix the second lateral support of the sliding rung relative to the second side support of the first multi-tool assembly. A first pin of the second multi-tool assembly can be configured to fix the first lateral support of the folding rung relative to the first side support of the second multi-tool assembly, and a second pin of the second multi-tool assembly can be configured to fix the second lateral support of the folding rung relative to the second side support of the second multi-tool assembly. In some cases, a panel of the first multi-tool assembly abuts the panel of the second multi-tool assembly when the first multi-tool assembly and the second multi-tool assembly are coupled together.

Sliding Rung

Figure 6A:
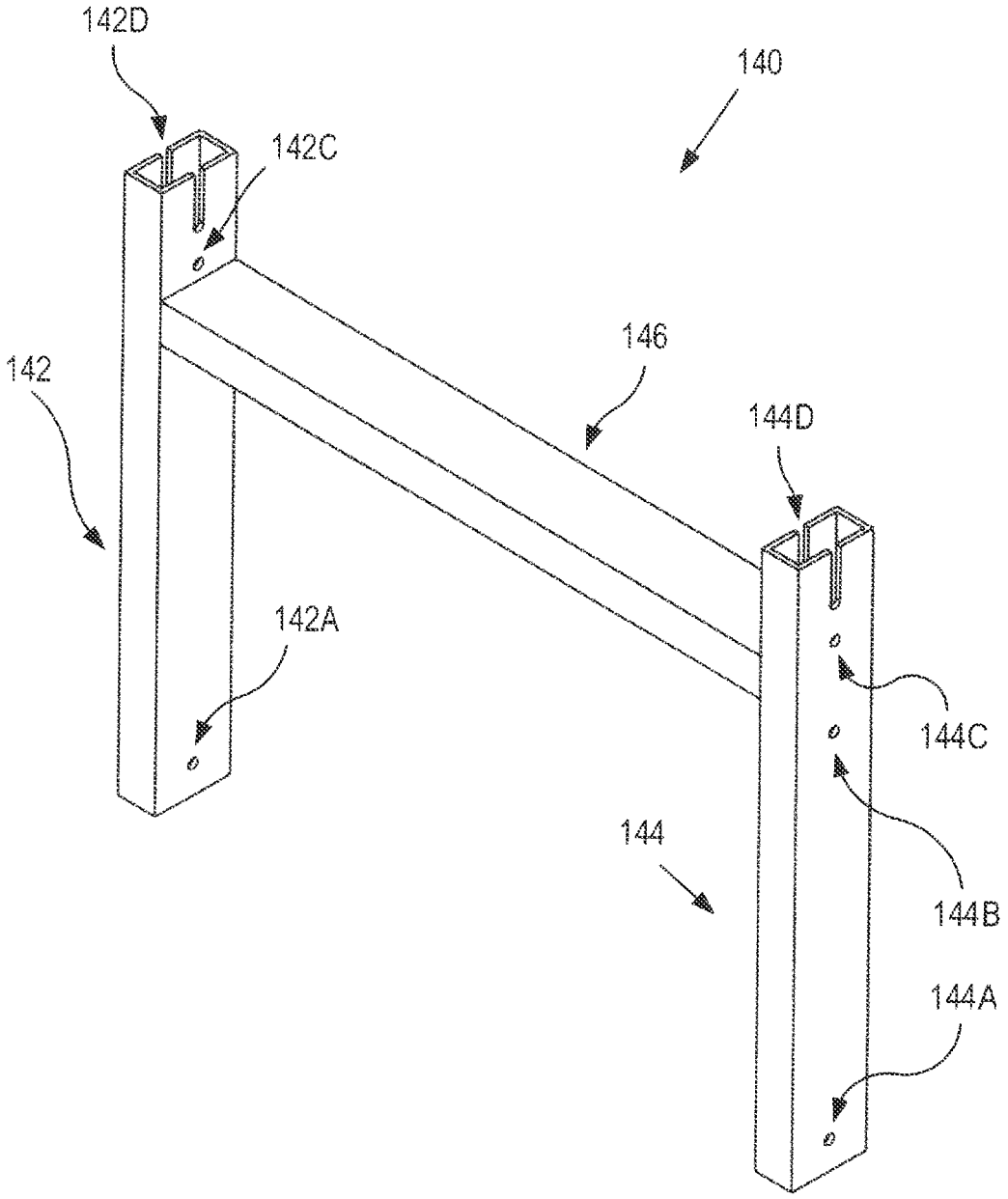
FIGS. 6A to 6D depict aspects of exemplary survivability/assault multi-tool (SAM) assemblies, according to certain embodiments of the invention.

FIG. 6A depicts aspects of a sliding rung 140, according to embodiments of the present invention. As shown here, sliding rung 140 includes a first lateral support 142, a second lateral support 144, and a sliding step 146 disposed between the first and second lateral supports. According to some embodiments, the sliding step 146 is coupled with the first lateral support 142 and the second lateral support 144 of the sliding rung 140. First lateral support 142 includes a proximal aperture 142A, a central aperture (not shown), a distal aperture 142C, and a distal slot 142D. Second lateral support 144 includes a proximal aperture 144A, a central aperture 144B, a distal aperture 144C, and a distal slot 144D.

Figure 6B:
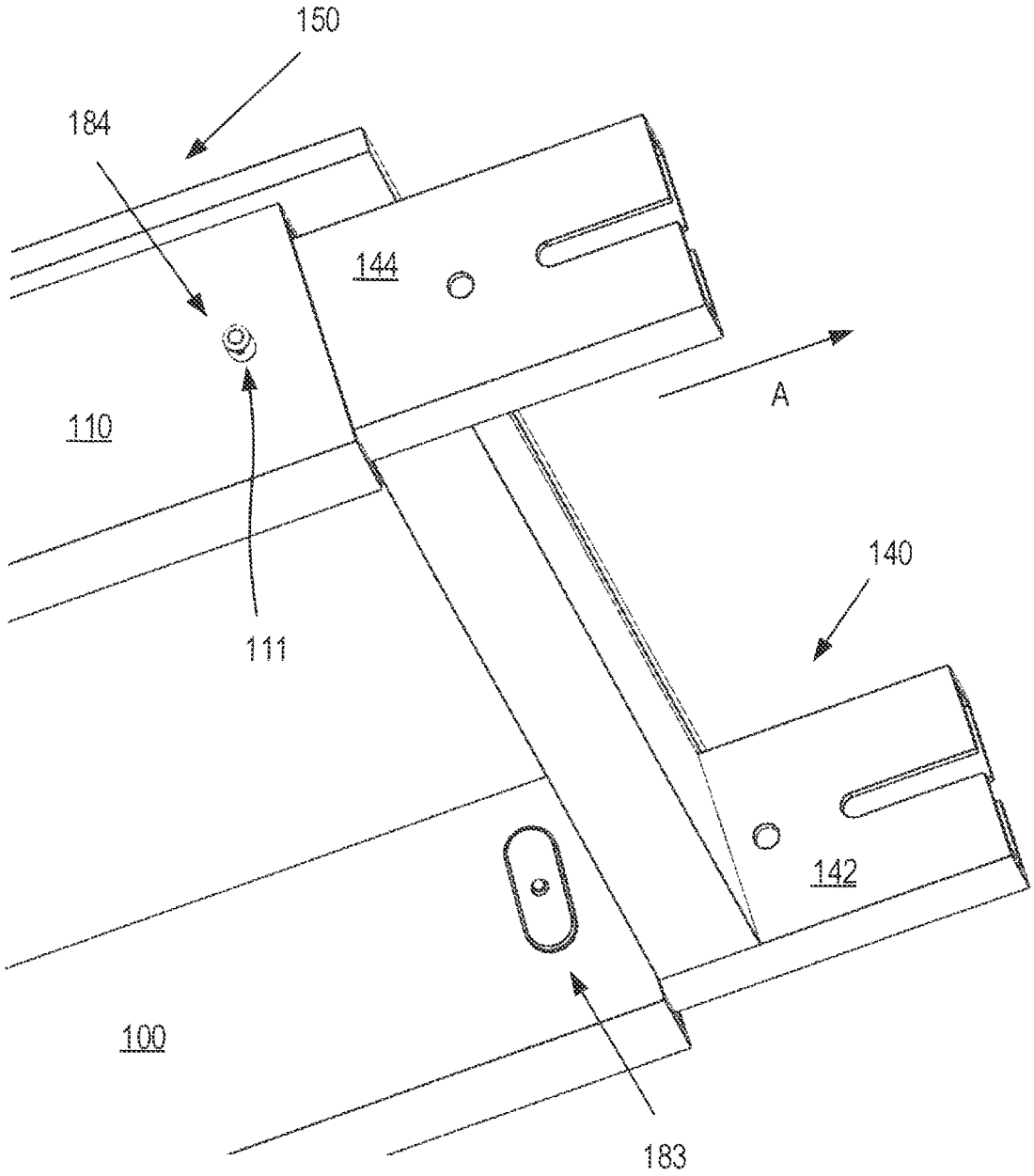

When the sliding rung 140 is positioned in the retracted position, as illustrated in FIG. 6B, the first lateral support 142 can be fixed relative to the first side support 100 via a first pin 183 and the second lateral support 144 can be fixed relative to the second side support 110 via a second pin 184. For example, the side supports may have apertures that are configured to receive the pins. Hence, a first lateral support 142 of the sliding rung can have an aperture, a second lateral support 144 of the sliding rung can have an aperture, a first side support 100 can have an aperture, a second side support 110 can have an aperture, and a survivability and assault multi-tool assembly can further include a first sliding rung pin and a second sliding rung pin, where the first sliding rung pin is positioned within the aperture of the first lateral support 142 of the sliding rung and within the aperture of the first side support 100, and where the second sliding rung pin is positioned within the aperture of the second lateral support 144 of the sliding rung and within the aperture of the second side support 110. The first lateral support 142 of the sliding rung can be slidably received by the first side support 100, and the second lateral support 144 of the sliding rung can be slidably received by the second side support 110.

Figure 6C:
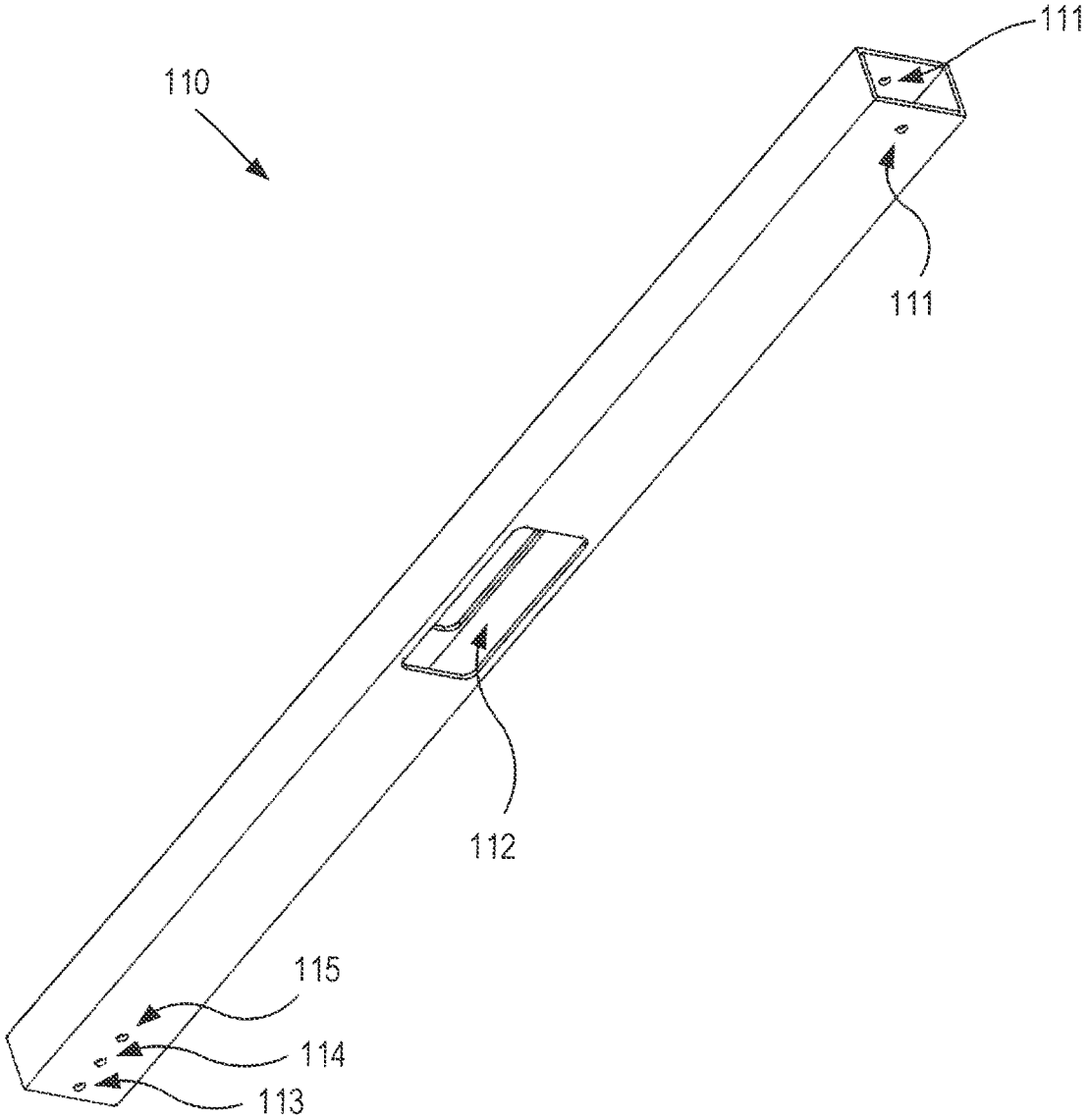

FIG. 6C shows a second side support 110 having a sliding end aperture 111 (or set of apertures 111), a folding end distal aperture 113 (or set of apertures), a folding end central aperture 114 (or set of apertures), and a folding end proximal aperture 115 (or set of apertures). Hence, a second pin 184 (as depicted in FIG. 6B) can be inserted through a central aperture 144B of a sliding rung 140 (as depicted in FIG. 6A) and also through a set of sliding end apertures 111 of a second side support 110 (as depicted in FIG. 6C). A first pin can be inserted through a central aperture of a sliding rung and also through a set of sliding end apertures of a first side support, in an analogous fashion.

Figure 6D:
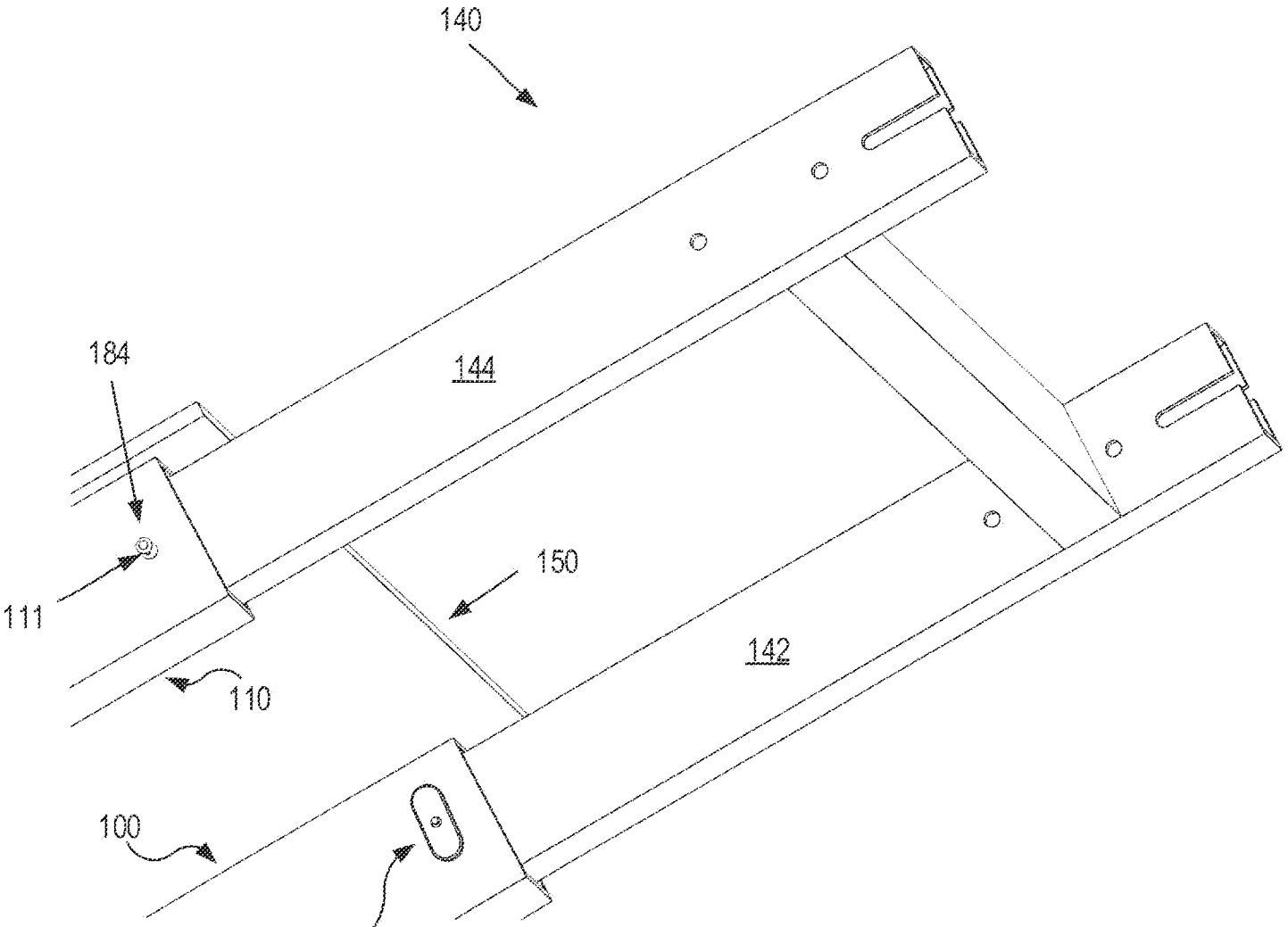

With returning reference to FIG. 6B, to extend the sliding rung 140, the pins 183, 184 can be removed, and the sliding rung 140 can be advanced distally as indicated by arrow A. When, for example, the proximal aperture 144A (or apertures) as depicted in FIG. 6A is aligned with the sliding end aperture 111 (or set of apertures 111) as depicted in FIG. 6C, the second pin 184 can be inserted through the apertures 144A, 111 so as to lock or fix the sliding rung in the extended position. A first pin can be inserted through a proximal aperture of a sliding rung and also through a set of sliding end apertures of a first side support, in an analogous fashion. FIG. 6D depicts the sliding rung 140 in the extended position. The proximal apertures (not shown) of the first lateral support 142 and the proximal apertures (not shown) of the second lateral support 144 are aligned with the sliding end apertures (e.g. 111) of the first side support 100 and second side support 110, respectively. The first lateral support 142 can be fixed relative to the first side support 100 via a first pin 183 and the second lateral support 144 can be fixed relative to the second side support 110 via a second pin 184.

Folding Rung

Figure 7A:
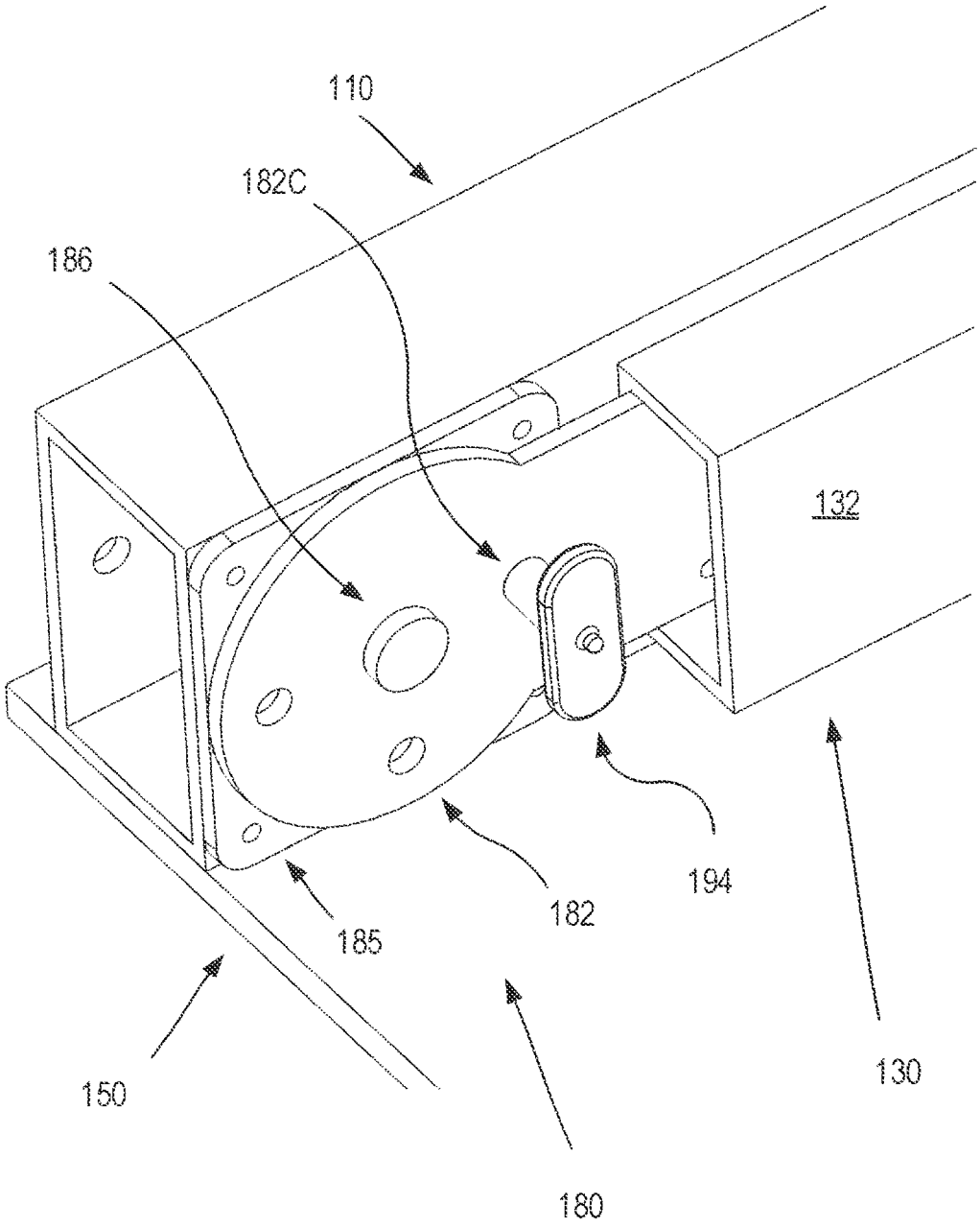
FIGS. 7A to 7E depict aspects of exemplary survivability/assault multi-tool (SAM) assemblies, according to certain embodiments of the invention.

FIG. 7A depicts aspects of a pivoting connection or coupling between a folding rung 130 and a second side support 110, according to embodiments of the present invention. As shown here, folding rung 130 can be coupled with second side support 110 via a hinge 180. In some cases, hinge 180 includes a hinge post 182, a hinge plate 185, and a hinge bearing 186. In the embodiment depicted here, it can be seen that the lateral support 132 of the folding rung 130 can be fixed at a 0° angle relative to the side support 110 of the multi-tool assembly (e.g. in contrast to the 90° angle depicted in FIG. 7C and the 180° angle depicted in FIG. 7D). According to some embodiments, a first hinge post can be pivotably coupled with a first side support via a first hinge bearing, and a second hinge post can be pivotably coupled with the second side support via a second hinge bearing.

Figure 7B:
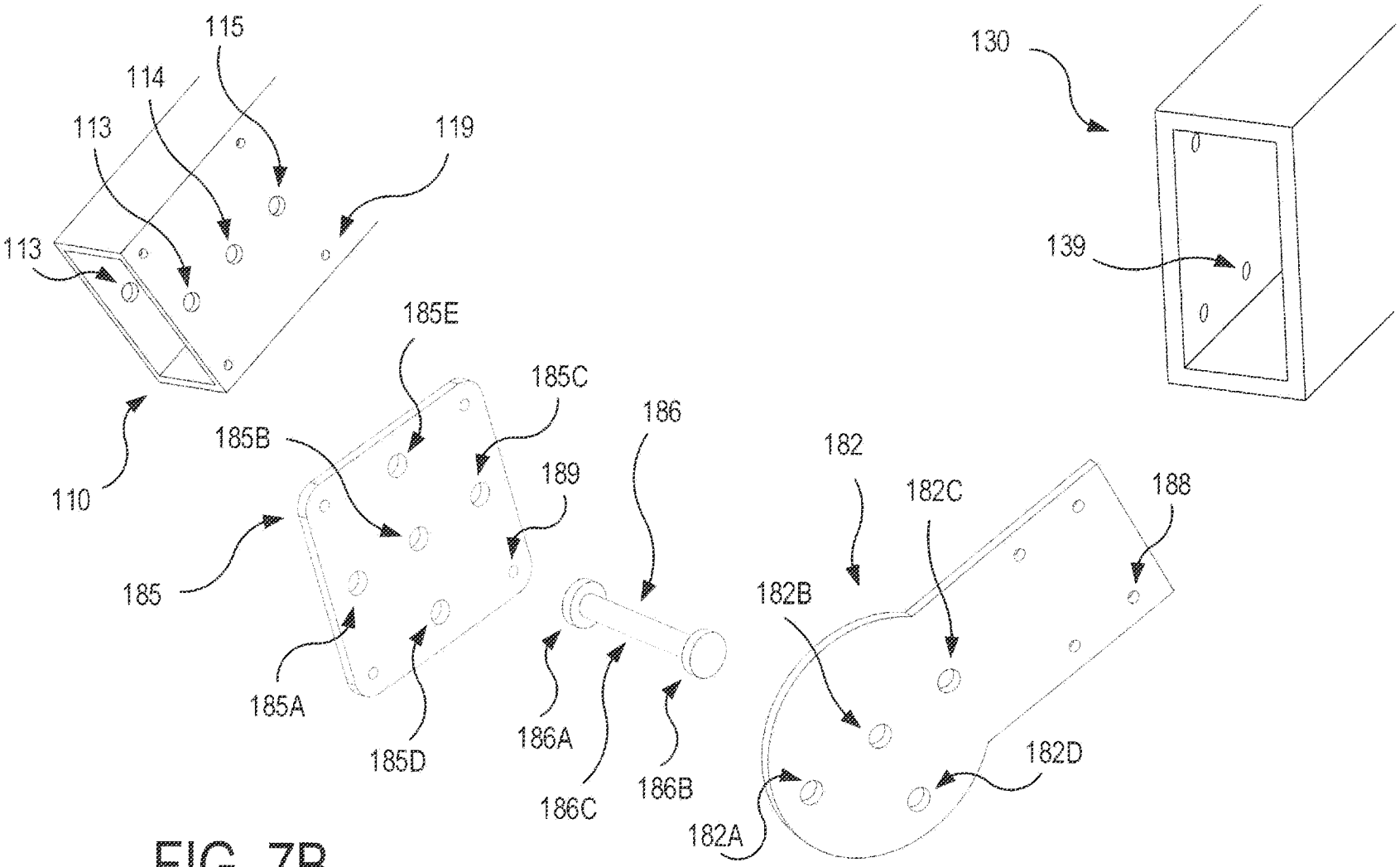

In the disassembled view depicted in FIG. 7B, it can be seen that second side support 110 includes a folding end distal aperture 113 (or set of apertures), a folding end central aperture 114 (or set of apertures), and a folding end proximal aperture 115 (or set of apertures). The hinge plate 185 includes a distal aperture 185A (for alignment with folding end distal aperture 113 of second side support 110), a central aperture 185B (for alignment with folding end central aperture 114 of second side support 110), a proximal aperture 185C (for alignment with folding end proximal aperture 115 of second side support 110), an upper aperture 185D that is disposed toward a panel (not shown), and a lower aperture 185E that is disposed away from the panel.

In some cases, the second side support 110 may include connection points or apertures 119 that, in concert with connection points or apertures 189 of the hinge plate 185, operate to provide a fixed connection between the second side support 110 and the hinge plate 185. For example, one or more rivets or bolts/nuts can be used to provide the fixed connection.

Hinge bearing 186 includes a lateral cap 186A, a medial cap 186B, and an axle 186C therebetween. Hinge post 182 includes a distal aperture 182A, a central aperture 182B, a proximal aperture 182C, and an upper aperture 182D. In some cases, the folding rung 130 may include connection points or apertures 139 that, in concert with connection points or apertures 188 of the hinge post 182, operate to provide a fixed connection between the folding rung 130 and the hinge post 182. For example, one or more rivets or bolts/nuts can be used to provide the fixed connection. The hinge bearing 186 can be engaged with the second side support 110, hinge plate 185, and hinge post 182, so that the central axle 186C is disposed within the folding end central aperture 114 (or set of apertures) of second side support 110, within the central aperture 185B of the hinge plate 185, and within the central aperture 182B of the hinge post 182.

When the folding rung 130 is in the retracted or folded position, the proximal aperture 182C of the hinge post 182 is aligned with the proximal aperture 1850 of the hinge plate 185 (and also with the proximal aperture 115 of second side support 110) and a second pin 194 (as depicted in FIG. 7A) can be inserted therethrough.

Figure 7C:
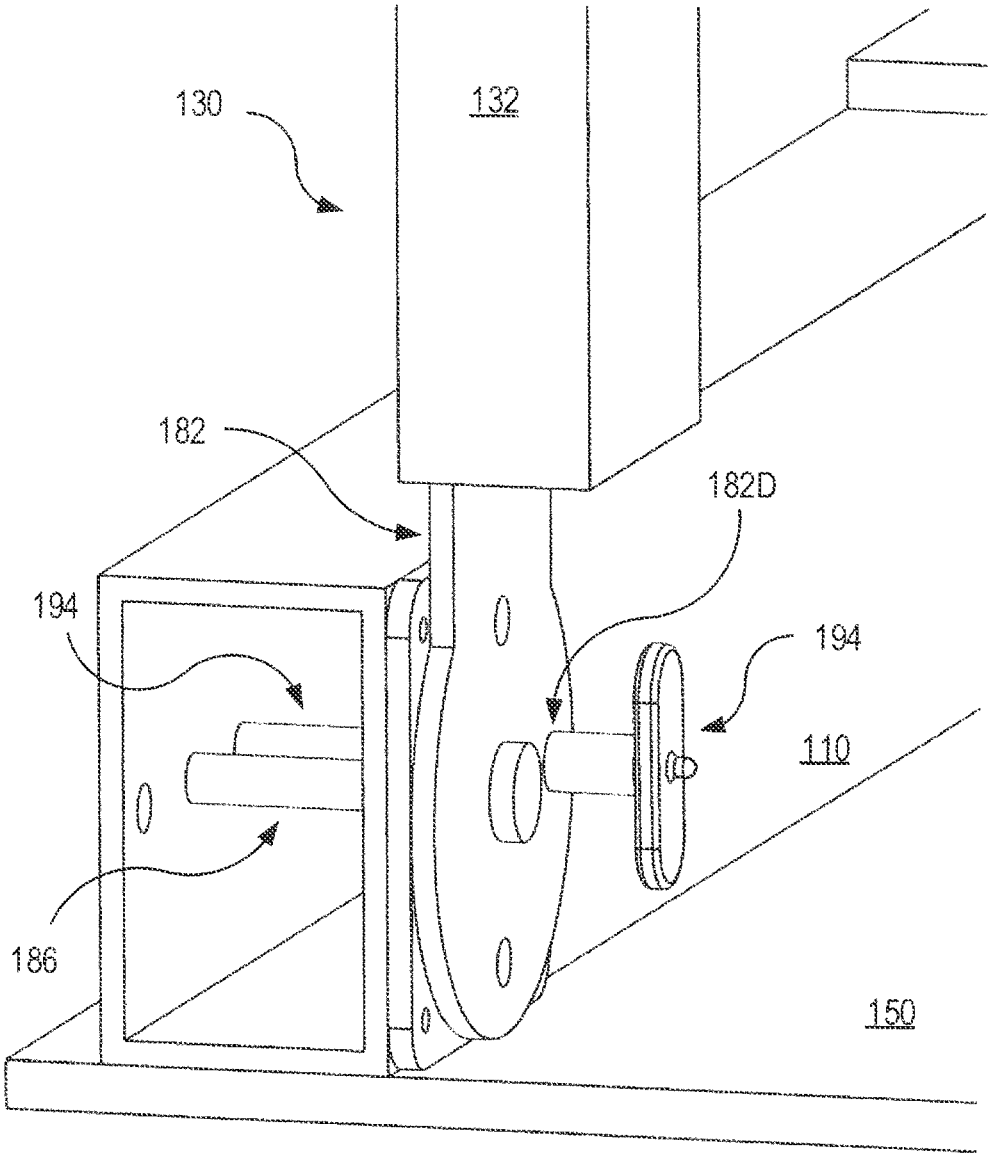

When the folding rung 130 is in the partially retracted or partially unfolded position, the upper aperture 182D of the hinge post 182 is aligned with the proximal aperture 1850 of the hinge plate 185 (and also with the proximal aperture 115 of second side support 110) and a second pin 194 can be inserted therethrough. For example, as depicted in FIG. 7C, the second lateral support 132 of the folding rung 130 is at a 90° angle with the second side support 110, and the second pin 194 is positioned through the upper aperture 182D of the hinge post 182. The combination of the hinge bearing 186 and the pin 194 provides a moment connection.

Figure 7D:
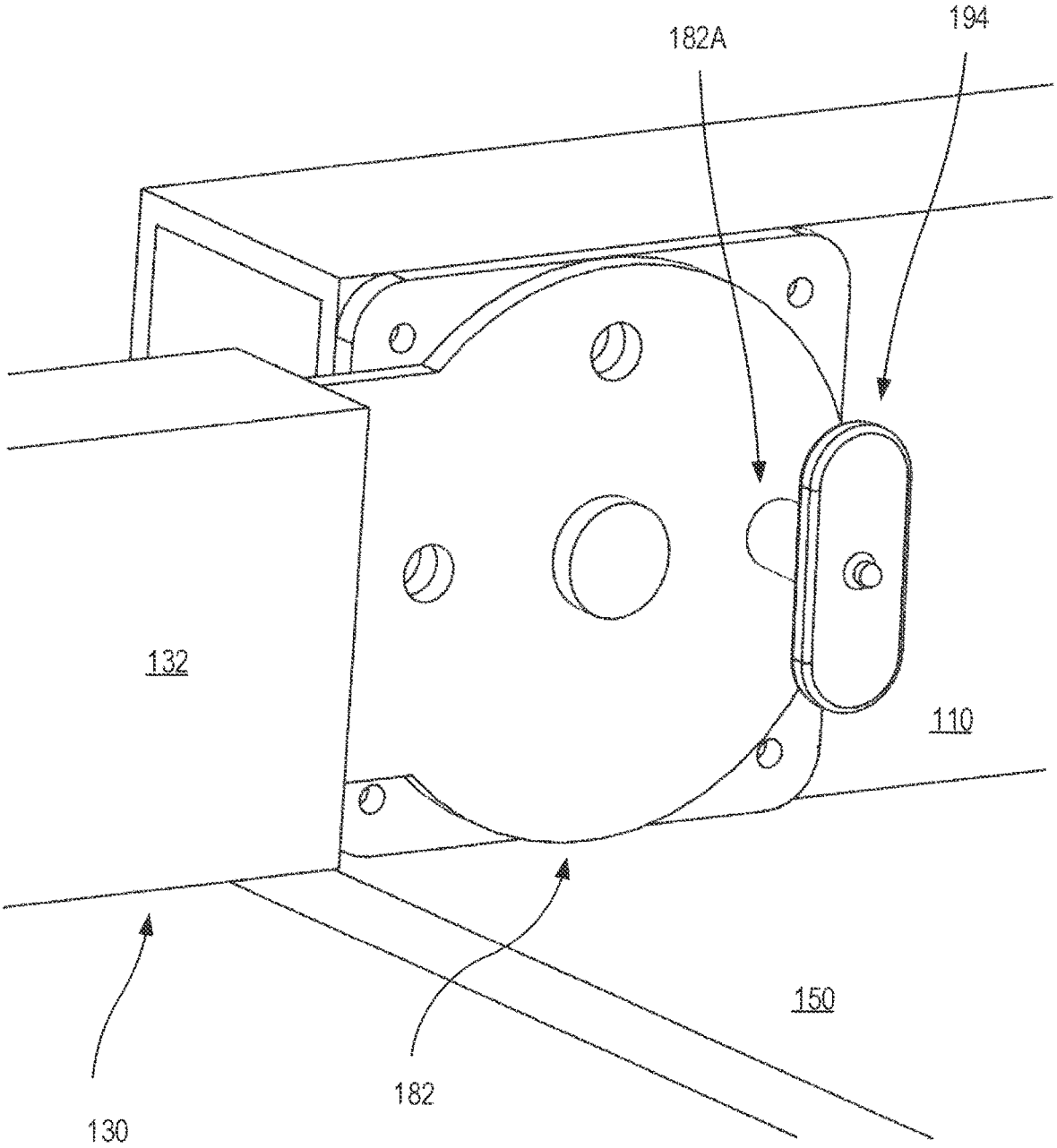

When the folding rung 130 is in the un-retracted or fully unfolded position, the distal aperture 182A of the hinge post 182 is aligned with the proximal aperture 185C of the hinge plate 185 (and also with the proximal aperture 115 of second side support 110) and a second pin 194 can be inserted therethrough. For example, as depicted in FIG. 7D, the second lateral support 132 of the folding rung 130 is at a 180° angle with the second side support 110, and the second pin 194 is positioned through the distal aperture 182A of the hinge post 182.

The folding rung 130 can be rotated to the desired position (folded, partially folded/unfolded, or unfolded) by rotating the hinge post 182 (and by extension, the folding rung 130) about the pivoting axis provided by the hinge bearing 186.

Figure 7E:
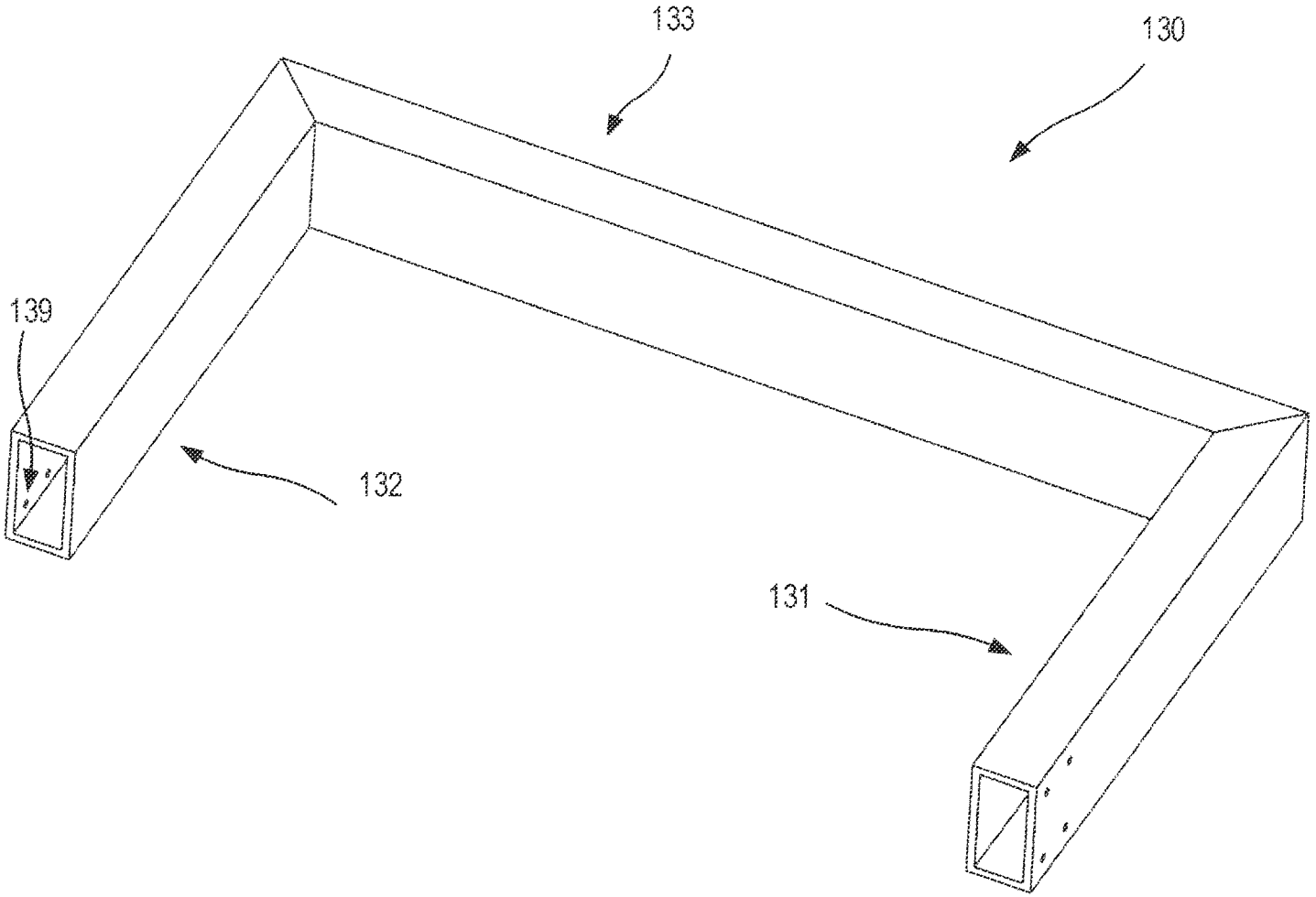

FIG. 7E depicts aspects of a folding rung 130. As shown here, folding rung 130 can include a first lateral support 131, a second lateral support 132, and a folding step 133. According to some embodiments, the folding step 133 can be coupled with the first lateral support 131 and the second lateral support 132 of the folding rung 130. Second lateral support 132 includes connection points or apertures 139 that, in concert with connection points or apertures of a hinge post, can secure the second lateral support with the hinge post. First lateral support 131 includes similar connection points or apertures.

Joined Assemblies

Figure 8:
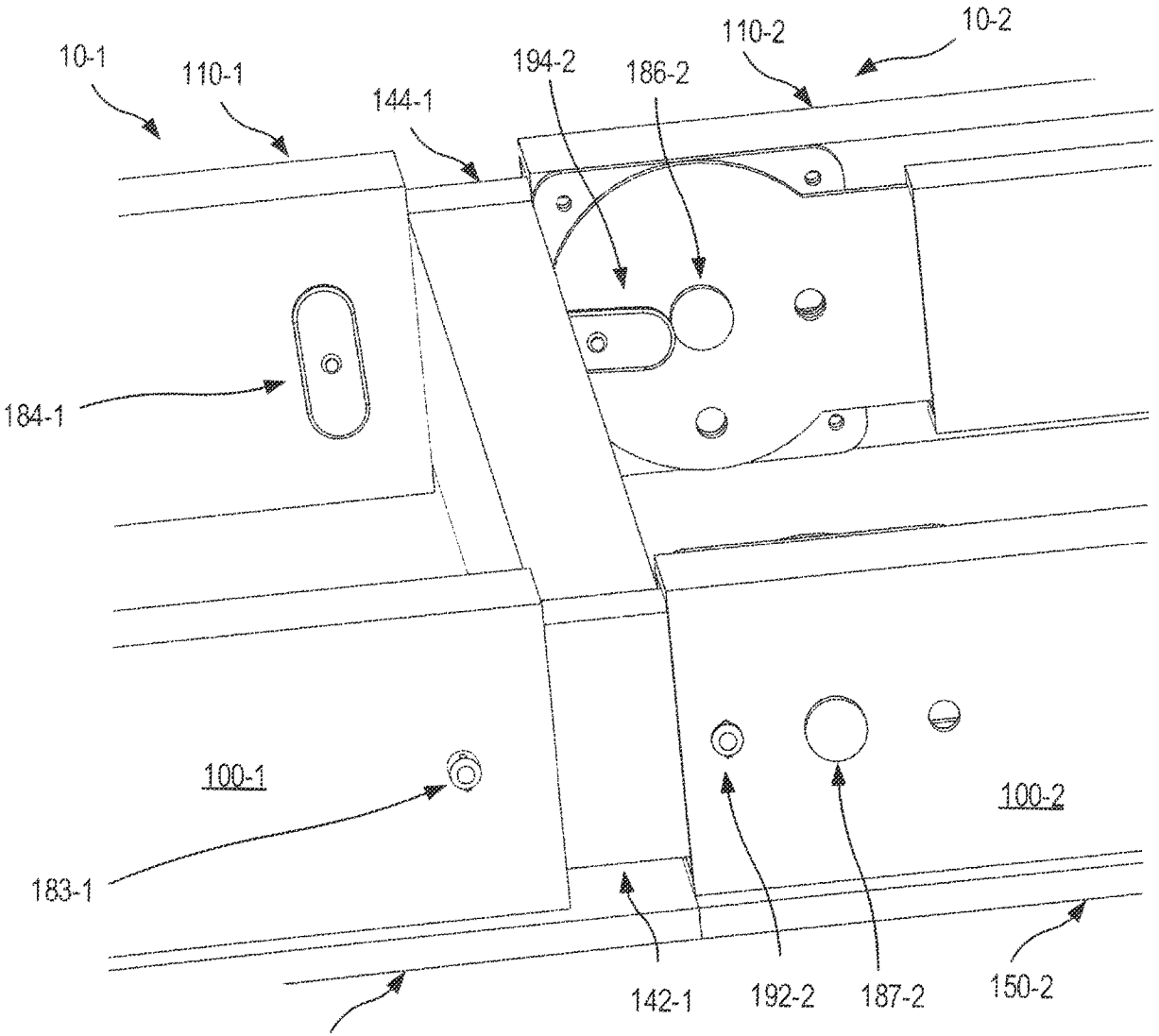
FIG. 8 depicts aspects of an exemplary survivability/assault multi-tool (SAM) system, according to certain embodiments of the invention.

When two assemblies 10-1, 10-2 are joined or coupled, as depicted in FIG. 8, the first side supports 100-1 and 100-2 are aligned, the second side supports 110-1 and 110-2 are aligned, and the panels 150-1 and 150-2 abut one another.

The first side support 100-2 of assembly 10-2 receives the first lateral support 142-1 of assembly 10-1. The second side support 110-2 of assembly 10-2 receives the second lateral support 144-1 of assembly 10-1. Pin 183-1 fixes first side support 100-1 relative to first lateral support 142-1, and pin 184-1 of assembly 10-1 fixes second side support 110-1 relative to second lateral support 144-1. Pin 192-2 fixes first side support 100-2 relative to first lateral support 142-1. Pin 194-1 fixes second side support 110-2 relative to second lateral support 144-1. A distal slot (not shown) of first lateral support 142-1 receives hinge bearing 187-2, and a distal slot (not shown) of second lateral support 144-1 receives hinge bearing 186-2. Pin 192-2 passes through a distal aperture (not shown) of first lateral support 142-1, and pin 194-2 passes through a distal aperture (not shown) of second lateral support 144-1. Hence, a first lateral support 142-1 of a folding rung can include an aperture, a second lateral support 144-1 of the folding rung can include an aperture, a first side support can include an aperture, and a second side support can include an aperture. A survivability and assault multi-tool assembly can include a first folding rung pin and a second folding rung pin, where the first folding rung pin is positioned within the aperture of the first lateral support 142-1 of the folding rung and within the aperture of the first side support, and where the second sliding rung pin is positioned within the aperture of the second lateral support 144-1 of the folding rung and within the aperture of the second side support.

Unless explicitly stated otherwise, each numerical value and range should be interpreted as being approximate as if the word "about" or "approximately" preceded the value or range.

Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

All documents mentioned herein are hereby incorporated by reference in their entirety or alternatively to provide the disclosure for which they were specifically relied upon.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A survivability and assault multi-tool assembly, comprising:

a first side support;

a second side support;

a middle rung coupled with the first side support and the second side support;

a panel coupled with the first side support and the second side support;

a folding rung coupled with the first side support and the second side support; and a sliding rung coupled with the first side support and the second side support.

2. The survivability and assault multi-tool assembly according to claim 1, further comprising an arm strap coupled with the panel.

3. The survivability and assault multi-tool assembly according to claim 2, wherein the second side support comprises a handhold aperture and a support plate.

4. The survivability and assault multi-tool assembly according to claim 1, wherein the sliding rung comprises a first lateral support, a second lateral support, and a sliding step coupled with the first lateral support and the second lateral support of the sliding rung.

5. The survivability and assault multi-tool assembly according to claim 4, wherein the first lateral support of the sliding rung comprises an aperture, wherein the second lateral support of the sliding rung comprises an aperture, wherein the first side support comprises an aperture, wherein the second side support comprises an aperture, wherein the survivability and assault multi-tool assembly further comprises a first sliding rung pin and a second sliding rung pin, wherein the first sliding rung pin is positioned within the aperture of the first lateral support of the sliding rung and within the aperture of the first side support, and wherein the second sliding rung pin is positioned within the aperture of the second lateral support of the sliding rung and within the aperture of the second side support.

6. The survivability and assault multi-tool assembly according to claim 4, wherein the first lateral support of the sliding rung is slidably received by the first side support, and wherein the second lateral support of the sliding rung is slidably received by the second side support.

7. The survivability and assault multi-tool assembly according to claim 1, wherein the folding rung comprises a first lateral support, a second lateral support, and a folding step coupled with the first lateral support and the second lateral support of the folding rung.

8. The survivability and assault multi-tool assembly according to claim 7, wherein the first lateral support of the folding rung comprises an aperture, wherein the second lateral support of the folding rung comprises an aperture, wherein the first side support comprises an aperture, wherein the second side support comprises an aperture, wherein the survivability and assault multi-tool assembly further comprises a first folding rung pin and a second folding rung pin, wherein the first folding rung pin is positioned within the aperture of the first lateral support of the folding rung and within the aperture of the first side support, and wherein the second sliding rung pin is positioned within the aperture of the second lateral support of the folding rung and within the aperture of the second side support.

9. The survivability and assault multi-tool assembly according to claim 1, wherein the folding rung comprises a first lateral support and a second lateral support, wherein the first lateral support comprises a first hinge post having a distal aperture, a central aperture, a proximal aperture, and an upper aperture, and wherein the second lateral support comprises a second hinge post having a distal aperture, a central aperture, a proximal aperture.

10. The survivability and assault multi-tool assembly according to claim 9, wherein the first side support comprises an aperture, wherein the second side support comprises an aperture, wherein a first hinge bearing is positioned within the central aperture of the first hinge post and the aperture of the first side support to provide a pivoting connection between the first hinge post and the first side support, and wherein a second hinge bearing is positioned within the central aperture of the second hinge post and the aperture of the second side support to provide a pivoting connection between the second hinge post and the second side support.

11. A survivability and assault multi-tool system, comprising:

a first multi-tool assembly comprising a first side support, a second side support, a panel, and a sliding rung having a first lateral support and a second lateral support, and a second multi-tool assembly comprising a first side support, a second side support, a panel, and a folding rung having a first lateral support and a second lateral support, wherein the first lateral support of the sliding rung is slidably received by the first side support of the first multi-tool assembly and the second lateral support of the sliding rung is slidably received by the second side support of the first multi-tool assembly, wherein the first lateral support of the sliding rung is slidably received by the first side support of the second multi-tool assembly and the second lateral support of sliding rung is slidably received by the second side support of the second multi-tool assembly, wherein the first lateral support of the folding rung is pivotably coupled with the first side support of the second multi-tool assembly and the second lateral support of the folding rung is pivotably coupled with the second side support of the second multi-tool assembly, wherein a first pin of the first multi-tool assembly is configured to fix the first lateral support of the sliding rung relative to the first side support of the first multi-tool assembly, wherein a second pin of the first multi-tool assembly is configured to fix the second lateral support of the sliding rung relative to the second side support of the first multi-tool assembly, wherein a first pin of the second multi-tool assembly is configured to fix the first lateral support of the folding rung relative to the first side support of the second multi-tool assembly, and wherein a second pin of the second multi-tool assembly is configured to fix the second lateral support of the folding rung relative to the second side support of the second multi-tool assembly.

12. The survivability and assault multi-tool system according to claim 11, wherein the panel of the first multi-tool assembly abuts the panel of the second multi-tool assembly when the first multi-tool assembly and the second multi-tool assembly are coupled together.

13. A method of operating a survivability and assault multi-tool assembly, the method comprising:

slidably moving a sliding rung of the multi-tool assembly relative to a first side support and a second side support of the multi-tool assembly;

fixing the sliding rung of the multi-tool assembly relative to the first side support and the second side support of the multi-tool assembly;

pivotably moving a folding rung of the multi-tool assembly relative to the first side support and the second side support of the multi-tool assembly; and fixing the folding rung of the multi-tool assembly relative to the first side support and the second side support of the multi-tool assembly.

14. The method according to claim 13, wherein the multi-tool assembly further comprises a panel coupled with the first side support and the second side support.

15. The method according to claim 13, wherein the step of fixing the sliding rung of the multi-tool assembly relative to the first side support and the second side support of the multi-tool assembly comprises:

inserting a first pin through an aperture of a first lateral support of the sliding rung and through an aperture of the first side support; and inserting a second pin through an aperture of a second lateral support of the sliding rung and through an aperture of the second side support.

16. The method according to claim 13, wherein the step of fixing the folding rung of the multi-tool assembly relative to the first side support and the second side support of the multi-tool assembly comprises:

inserting a first pin through an aperture of a first hinge post of the folding rung and through an aperture of the first side support; and inserting a second pin through an aperture of a second hinge post of the folding rung and through an aperture of the second side support.

17. The method according to claim 16, wherein the first hinge post is pivotably coupled with the first side support via a first hinge bearing, and wherein the second hinge post is pivotably coupled with the second side support via a second hinge bearing.

18. The method according to claim 13, wherein the step of fixing the folding rung of the multi-tool assembly relative to the first side support and the second side support of the multi-tool assembly comprises:

fixing a first lateral support of the folding rung at a 90° angle relative to the first side support; and fixing a second lateral support of the folding rung at a 90° angle relative to the second side support.

19. The method according to claim 13, wherein the step of fixing the folding rung of the multi-tool assembly relative to the first side support and the second side support of the multi-tool assembly comprises:

fixing a first lateral support of the folding rung at a 180° angle relative to the first side support; and fixing a second lateral support of the folding rung at a 180° angle relative to the second side support.

20. The method according to claim 13, wherein the step of fixing the folding rung of the multi-tool assembly relative to the first side support and the second side support of the multi-tool assembly comprises:

fixing a first lateral support of the folding rung at a 0° angle relative to the first side support; and fixing a second lateral support of the folding rung at a 0° angle relative to the second side support.

* * * * *